US010384332B2

(12) United States Patent
Li

(10) Patent No.: US 10,384,332 B2
(45) Date of Patent: Aug. 20, 2019

(54) RATCHET CLAMP

(71) Applicants: HANGZHOU GREAT STAR TOOLS CO., LTD., Hangzhou City (CN); HANGZHOU GREAT STAR INDUSTRIAL CO., LTD., Hangzhou City (CN)

(72) Inventor: Yueming Li, Hangzhou (CN)

(73) Assignees: HANGZHOU GREAT STAR TOOLS CO., LTD., Hangzhou (CN); HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 114 days.

(21) Appl. No.: 15/547,078

(22) PCT Filed: Jan. 30, 2015

(86) PCT No.: PCT/CN2015/071961
§ 371 (c)(1),
(2) Date: Jul. 28, 2017

(87) PCT Pub. No.: WO2016/119223
PCT Pub. Date: Aug. 4, 2016

(65) Prior Publication Data

US 2017/0355066 A1 Dec. 14, 2017

(51) Int. Cl.
*B25B 5/04* (2006.01)
*B25B 7/14* (2006.01)
(Continued)

(52) U.S. Cl.
CPC ..... *B25B 7/14* (2013.01); *B25B 5/04* (2013.01); *B25B 5/16* (2013.01); *B25B 13/463* (2013.01)

(58) Field of Classification Search
CPC .... B25B 7/10; B25B 7/08; B25B 7/12; B25B 7/14; B25B 7/00; B25B 13/22; B25B 13/463; B25B 5/16; B25B 5/04
See application file for complete search history.

(56) References Cited

U.S. PATENT DOCUMENTS 6,708,587 B1 3/2004 Noniewicz et al.
8,225,700 B2 * 7/2012 Hile ..... B25B 7/123 81/367
(Continued)

FOREIGN PATENT DOCUMENTS

CN 2532944 Y 1/2003
CN 203019246 U 6/2013
CN 204094654 U 1/2015

OTHER PUBLICATIONS

International Search Report (with Partial English Translation) dated Apr. 9, 2015 corresponding to International Application No. PCT/CN2015/071961; 4 Pages.

*Primary Examiner* — Robert J Scruggs
(74) *Attorney, Agent, or Firm* — Daly, Crowley, Mofford & Durkee, LLP

(57) ABSTRACT

A ratchet clamp, comprises a first clamp arm, a second clamp arm and a ratchet mechanism provided between the first clamp arm and the second clamp arm. An elastic member is arranged between the ratchet mechanism and the second clamp arm. The ratchet mechanism includes a toothed bar, a pivoting member. The pivoting member includes a toothed piece, a housing and a lever. The self lock state of the ratchet clamp of the invention is very safe and stable, the maximum clamping force at the jaw opening portion can reach about 50 Kg, and 85% of the maximum clamping force can be maintained after the user releases the clamp arms.

22 Claims, 8 Drawing Sheets

(51) Int. Cl.
*B25B 5/16* (2006.01)
*B25B 13/46* (2006.01)

(56) References Cited

U.S. PATENT DOCUMENTS

2007/0044317 A1* 3/2007 Critelli ..... B23D 29/02
30/173
2015/0013507 A1 1/2015 Buchanan

* cited by examiner

RATCHET CLAMP

This application is a U.S. National Stage of PCT application PCT/CN2015/071961 filed in the Chinese language on Jan. 30, 2015, and entitled "RATCHET CLAMP," which application is hereby incorporated herein by reference in its entirety.

FIELD OF THE INVENTION

The invention relates to the field of hand tool and, particularly, to a ratchet clamp.

DESCRIPTION OF THE PRIOR ART

Hand tools refer to small tools that are gripped by hand, with which a person can apply manual forces or other manually controlled forces to objects for manual cutting and auxiliary decoration. Normally, they are provided with handles facilitating carrying. Pliers are a type of common hand tools used for clamping, securing a workpiece or twisting, bending, shearing metal threads, among which the pliers used for clamping, securing a workpiece are also known as pincers or clamps.

A pincer or clamp is generally in V-shape, and usually formed by two clamp bodies with symmetrical shape and structure which are partly superposed and secured by riveting. The clamp can flexibly open and close using its riveting joint as a pivot, which includes a lever principle, thereby transforming a smaller external force (such as a manual force applied to the clamp arms) into a larger clamping force at the clamp tip so that the clamp can clamp effectively.

Due to the absence of a mechanism locking the position of clamp arms in manual clamps in the prior art, the operator has to keep applying a larger force to the clamp when clamping an object until the clamping job is finished. This is both effort and time consuming, also the clamping is not steady. Regarding that, US Patent "Vise-Grip or Expanding Pliers" (U.S. Pat. No. 6,708,587B1) provides a technical solution using ratchet to lock the position of clamp arms, in which a member having ratchets is arranged on each of two clamp arms respectively, one of the members being stationary in relation to the clamp arm to which it is connected, the other of the members being rotatable in relation to the clamp arm to which it is connected, the ratchets on the two member being engaged with each other, the two sets of engaged ratchets being arranged so as to allow the movement of the two clamp arms toward each other rather than away from each other; and an actuating member is provided at the outside of one of the clamp arms (the side thereof away from the other clamp arm), in particular, a pushbutton that can automatically restore position; the actuating member is connected through a locking member to the member having ratchets and rotatable in relation to the clamp arms to which it is connected, so as to control whether the member having ratchets is engaged with the other member having ratchets.

When using the clamp, the locking member keeps the two sets of ratchets being engaged with each other and the two sets of ratchets can move in relation to each other when the user applies a pair of opposing forces to the two clamp arms (i.e. one clamp arm is subjected to a force in a direction pointing toward the other clamp arm), thereby allowing the two clamp arms to be movable toward each other, thus the two clamp tips are movable toward each other to hold the object to be clamped; when the object is clamped, the user withdraws the forces applied to the two clamp arms, and the locking member keeps the two sets of ratchets being engaged with each other, the two sets of ratchets being unmovable in relation to each other, thereby keeping the clamp tips in clamping state; when the user push down the actuating member and applies forces in opposite directions to the two clamp arms (i.e. one clamp arm is subjected to a force in a direction away from the other clamp arm), the locking member is opened and the clamping force is at least partly released, the two sets of ratchets no longer being engaged with each other, thereby allowing the two clamp arms to be movable in directions away from each other, thus the two clamp tips are movable away from each other to release the clamped object.

However, because the actuating member of the clamps of this prior art is arranged at the outside of one of the clamp arm, the user needs to push down the actuating member when releasing the clamped object. It is understood that when the user pushes down the actuating member, a force pointing toward the other clamp arm needs to be applied to the clamp arm where the actuating member is located, and the direction of the force is opposite to the direction of the forces applied to the hand gripping the clamp arms during the process of two actuations of the clamp arms, therefore, such operation is inconvenient and quite effort consuming.

Therefore, the person skilled in the field endeavors to develop a force relieving mechanism and a ratchet clamp having a force relieving mechanism to allow the user to operate conveniently and save efforts.

SUMMARY OF THE INVENTION

In view of the above defects in the prior art, the invention aims to solve the technical problem that the prior ratchet clamp is inconvenient and troublesome for the user to press down the stopper parts when releasing the ratchet clamp.

In order to realize the above object, the invention provides a ratchet clamp, comprising a first clamp arm, a second clamp arm and a ratchet mechanism provided between the first clamp arm and the second clamp arm, the first clamp arm and the second clamp arm being connected by a first shaft and rotatable about the first shaft so as to control the size of the jaw opening, characterized in that, an elastic element is provided between the ratchet mechanism and the second clamp arm; the ratchet mechanism comprising a toothed bar and a pivoting member, the toothed bar being fixedly arranged on the first clamp arm, the toothed bar being a circular arc in shape of a strip, the center point of the circular arc being substantially coinciding with that of the first shaft, a first set of ratchet teeth being provided at a side of the toothed bar away from the first shaft, the pivoting member being pivotable about a third shaft within an elastic range of the elastic member during clamping; upon removal of external force, the ratchet mechanism self locks and maintains a clamping force; when the clamp to be opened, an external force is exerted on the pivoting member so as to allow the ratchet mechanism to be unlocked and detached.

Further, the pivoting member comprises a toothed piece, a housing and a lever, the toothed piece being rotatable about a fourth shaft, a recess portion being provided on the toothed piece, a second set of ratchet teeth being provided at a side of the recess portion and in engagement with the first set of ratchet teeth of the toothed bar.

Further, the lever is in the form of an elongation, the lever being rotatable about a fifth shaft, a first protruding portion being provided at a first end portion of the lever, the first protruding portion and the recess portion of the toothed piece cooperating with each other, a second protruding portion being provided in the middle portion of the lever, the second protruding portion cooperating with the elastic member.

Further, a channel is provided in the housing, for the toothed bar to pass through, the housing being rotatable about the third shaft, a slot being provided at a side of the channel distal to a center point of the first shaft, the slot accommodating the toothed piece and the first end portion of the lever, the fourth shaft and the fifth shaft respectively passing through the slot and the toothed piece and the lever, an opening being provided on the separation of the channel and the slot.

Further, a first end of the elastic member is arranged on the second clamp arm, a second end of the elastic member is arranged to cooperate with the second protruding portion of the lever, and when the lever is free from external force, the lever rotates about the fifth shaft due to the elastic force of the elastic member, the first protruding portion of the lever exerting a force to the toothed piece in a direction toward where the first set of ratchet teeth and the second set of ratchet teeth are engaged with each other, so that the toothed piece rotates about the fourth shaft and meanwhile, the engagement between the first set of ratchet teeth and the second set of ratchet teeth becomes tighter.

Further, the first set of ratchet teeth of the toothed bar is provided with an undercut, and when a user removes forces exerted to the first clamp arm and the second clamp arm, the toothed piece is subjected to a circumferential acting force in an opposite direction of rotation about the fourth shaft, so that the toothed bar and the toothed piece are engaged and locked with each other.

Further, when a user exerts forces to the first clamp arm and the second clamp arm to cause the first clamp arm and the second clamp arm to come closer to each other, the toothed bar and the housing are in relative movement, so that the pivoting member rotates about the third shaft in whole, so that the elastic member is compressed under stress and meanwhile, the first set of ratchet teeth of the toothed bar and the second ratchet teeth of the toothed piece are accordingly caused to be in a cycle process of engagement-open-re-engagement.

Further, when a user exerts a force to an end of the lever so that the elastic member is compressed under stress, the lever is rotatable about the fifth shaft, the first protruding portion of the lever pulling the toothed piece to rotate about the fourth shaft, so that the first ratchet teeth of the toothed bar and the second ratchet teeth of the toothed piece are opened accordingly, so that the toothed bar is rotatable in the channel of the housing.

Further, the toothed bar and the toothed piece are in an interference fit.

Further, angle $\alpha$ is an angle formed between, a forced direction of a tooth profile of an engaged part of the first ratchet teeth and the second ratchet teeth, and a connection line between a forced point and a rotation center point of the toothed piece, the angle $\alpha$ being in a range of between 2°-8°.

Further, the angle $\alpha$ is preferably 4°.

Further, the second set of ratchet teeth has at least more than one tooth.

Further, preferably three teeth.

Further, the elastic member is a spring.

The invention also provides a ratchet clamp, comprising a pair of clamp bodies, a ratchet mechanism provided between the clamp bodies, the clamp bodies comprising a clamp arm and an upper clamp body, a first upper clamp body and a second upper clamp body being pivotally connected by a first shaft, characterized in that, the clamp bodies are divided into two sections or more sections in pivot connections; the first upper clamp body being fixed relative to the first shaft, the second upper clamp body being rotatable relative to the first shaft; the first upper clamp body and a first clamp arm being in pivot connection by a seventh shaft, the second upper clamp body and a second clamp arm being in pivot connection by a third shaft; the ratchet mechanism comprises a toothed bar and a pivoting member, the toothed bar being fixedly arranged on the first upper clamp body, the toothed bar being a circular arc in shape of a strip, a center point of the circular arc substantially coinciding with that of the first shaft, a first set of ratchet teeth being provided at a side of the toothed bar distal to the first shaft; and a third set of ratchet teeth being provided on dial teeth in pivot connection with the first clamp arm, the third set of ratchet teeth being in engagement with the toothed bar, the toothed bar being pushed by the toothed piece during clamping.

Further, the pivoting member comprises a toothed piece, a housing and a lever, the toothed piece being rotatable about a fourth shaft, a recess portion being provided on the toothed piece, a second set of ratchet teeth being provided at a side of the recess portion and in engagement with the first set of ratchet teeth of the toothed bar.

Further, the lever is in the form of an elongation, the lever being rotatable about a fifth shaft, a first protruding portion being provided at a first end portion of the lever, the first protruding portion and the recess portion of the toothed piece cooperating with each other.

Further, a channel is provided in the housing, for the toothed bar to pass through, the housing being rotatable about the third shaft, a slot being provided at a side of the channel distal to a center point of the first shaft, the slot accommodating the toothed piece and the first end portion of the lever, the fourth shaft and the fifth shaft respectively passing through the slot and the toothed piece and the lever, an opening being provided on the separation of the channel and the slot.

Further, the first set of ratchet teeth of the toothed bar is provided with an undercut, and when a user removes forces exerted to the first clamp arm and the second clamp arm, the toothed piece is subjected to a circumferential acting force in an opposite direction of rotation about the fourth shaft, so that the toothed bar and the toothed piece are engaged and locked with each other.

Further, when a user exerts forces to the first clamp arm and the second clamp arm to cause the first clamp arm and the second clamp arm to come closer to each other, the toothed bar and the housing are in relative movement, so that the pivoting member rotates about the third shaft in whole, so that the elastic member is compressed under stress and meanwhile, the first set of ratchet teeth of the toothed bar and the second ratchet teeth of the toothed piece are accordingly caused to be in a cycle process of engagement-open-re-engagement.

Further, when a user exerts a force to an end of the lever so that the elastic member is compressed under stress, the lever is rotatable about the fifth shaft, the first protruding portion of the lever pulling the toothed piece to rotate about the fourth shaft, so that the first ratchet teeth of the toothed bar and the second ratchet teeth of the toothed piece are opened accordingly, so that the toothed bar is rotatable in the channel of the housing.

Further, the toothed bar and the toothed piece are in an interference fit.

Further, angle $\alpha$ is an angle formed between, a forced direction of a tooth profile of an engaged part of the first ratchet teeth and the second ratchet teeth, and a connection line between a forced point and a rotation center point of the toothed piece, the angle α being in a range of between 2°-8°.

Further, the angle α is preferably 4°.

Further, the second set of ratchet teeth has at least more than one tooth.

Further, preferably three teeth.

The invention provides a ratchet clamp, comprising a first clamp arm, a second clamp arm and a ratchet mechanism provided between the first clamp arm and the second clamp arm. An elastic member is arranged between the ratchet mechanism and the second clamp arm. The ratchet mechanism includes a toothed bar, a pivoting member. The pivoting member includes a toothed piece, a housing and a lever. During clamping, the pivoting member pivots in whole within a certain range under the effect of the elastic member, and the toothed bar and toothed piece are engaged by undercut, maintaining the clamping force, and the elastic member protects the engagement between the toothed bar and the toothed piece from sliding apart. When opened, the interference fit between the toothed bar and the toothed piece enable the user to use small force pulling the lever to disengage the toothed piece, and also prevent accidental unloading force from opening the ratchet mechanism. The second set of ratchet teeth on the toothed piece has at least more than one tooth, preferably three. In order to enable stable and reliable engagement between the toothed bar and the toothed piece, the tooth profile of the both in engagement is configured such that the force produced thereby cause the toothed piece to generate a counter-clockwise torque, that is, the forced direction of the tooth profile of the engaged part and the connection line between the forced point and the rotation center point of the toothed piece form an angle α. Because of the deformation of the ratchet clamp of the invention when under stress, deformation of the toothed bar and the toothed piece also occurs. In order to ensure reliable engagement between the toothed bar and the toothed piece, and that, meanwhile, the engagement stress between the both can be overcome when the lever is pulled, to detach the both, and the force for pulling the lever should not be too great (generally between 5-10 kg), the angle α is in the range of between 2°-8°, preferably 4°. When the number of the teeth in engagement between the toothed bar and the toothed piece is more than 1, the both can reliably engage with each other as long as the resultant moment formed between all the teeth in engagement is ensured to cause a trend of a counter-clockwise motion of the toothed piece. The self lock state of the ratchet clamp of the invention is very safe and stable, the maximum clamping force at the jaw opening portion can reach about 50 Kg, and 85% of the maximum clamping force can be maintained after the user releases the clamp arms.

Referring now to the figures, the conception, detailed structure and induced technical effect of the present invention will be expounded for due understanding of the purpose, characterizations and effects of the present invention.

DETAILED DESCRIPTION OF THE PREFERRED EMBODIMENTS

Figure 1:
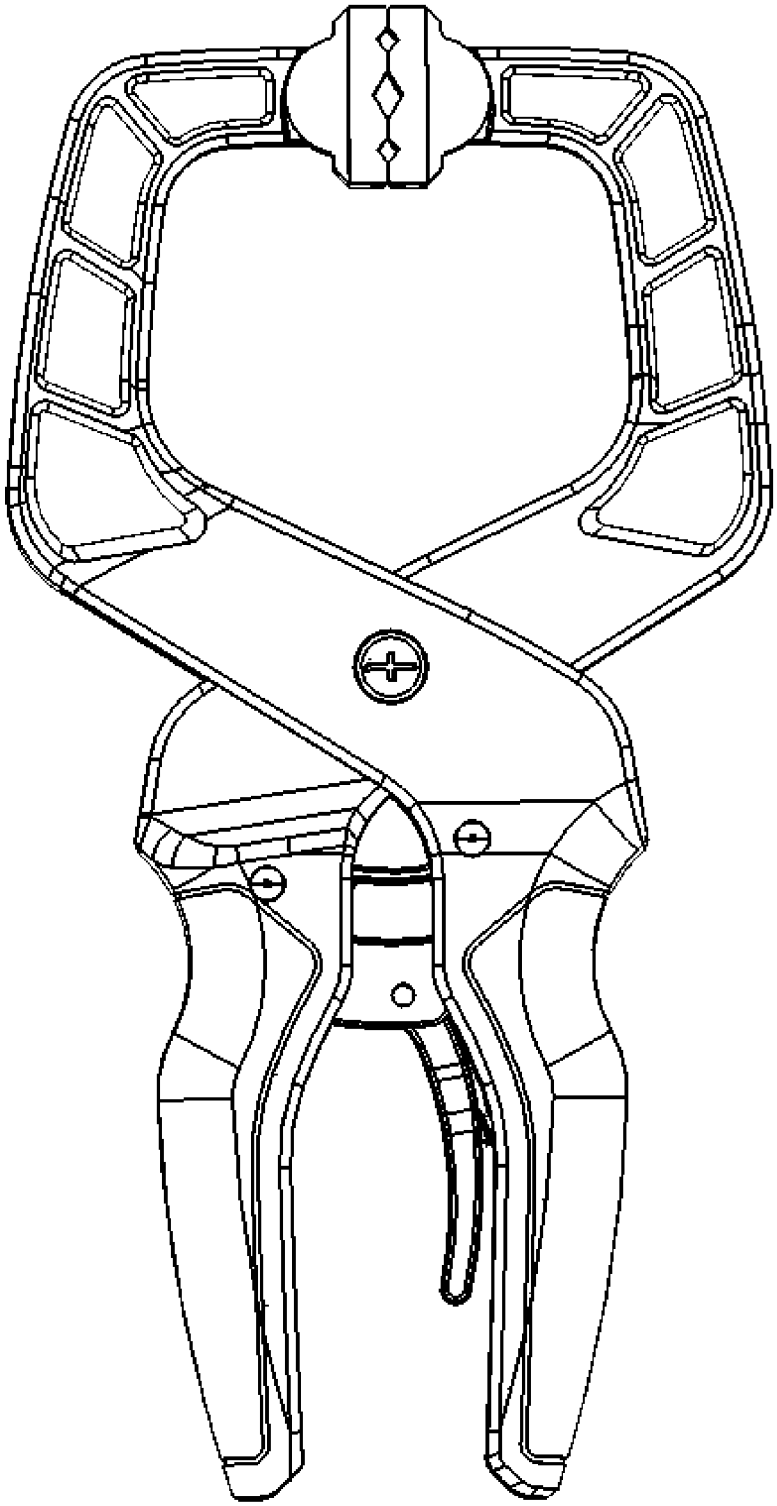
FIG. 1 is a front view of the ratchet clamp in a preferred embodiment of the present invention.

FIG. 1 shows a preferred embodiment of the present invention.

Figure 2:
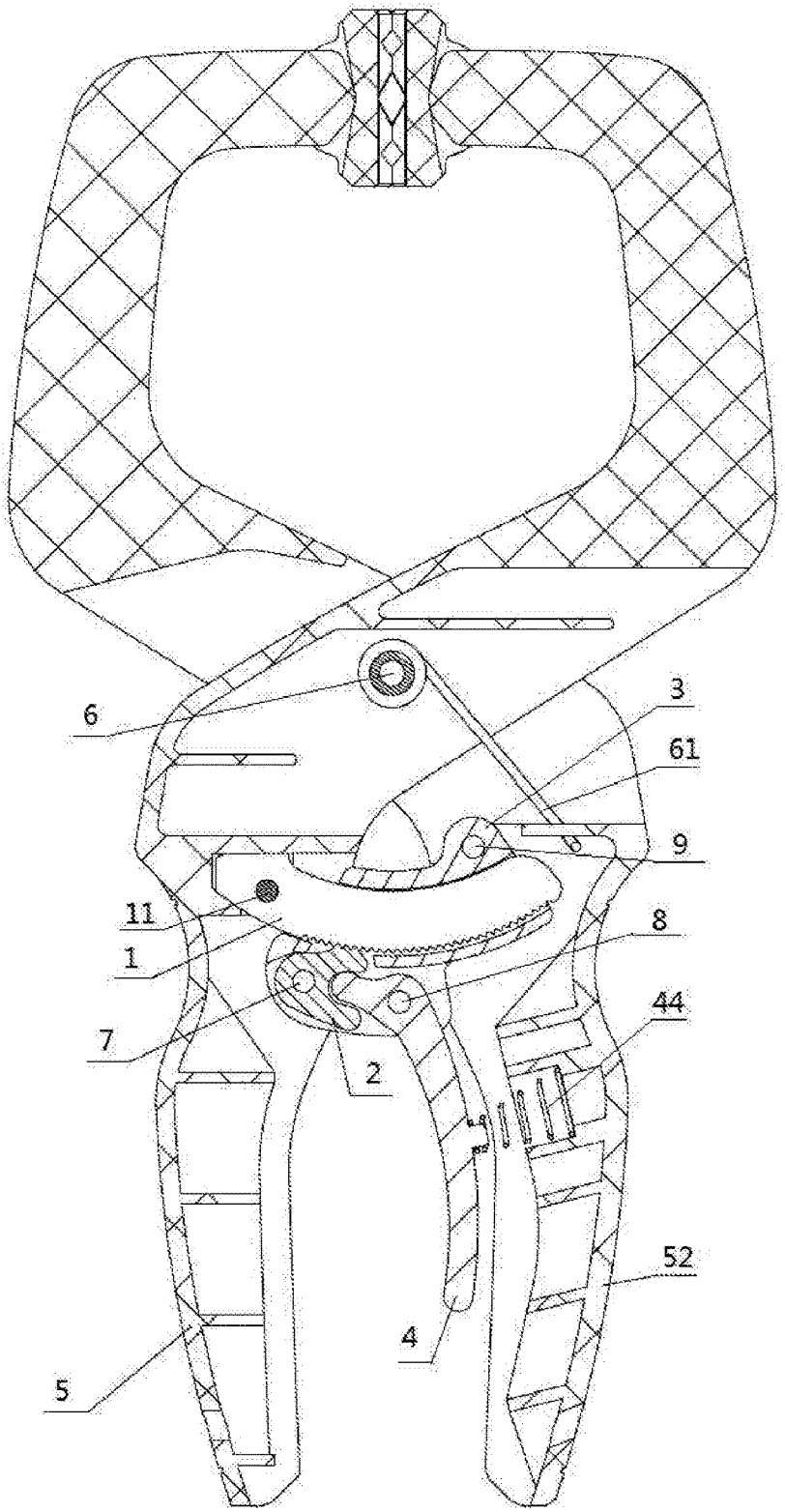
FIG. 2 is a sectional view of the ratchet clamp in a preferred embodiment of the present invention.

As shown in FIG. 2, a first clamp arm 5 and a second clamp arm 52 of the ratchet clamp of the present invention are connected by a first shaft 6, and are rotatable about the first shaft 6 to control the size of the jaw opening, that is, to open and close. In particular, when a user exerts a force to the first clamp arm 5 and the second clamp arm 52 to cause them to come close to each other (that is, the first clamp arm 5 and the second clamp arm 52 move toward each other), the jaw opening becomes smaller and is fixed at a desired position by a ratchet mechanism 0, so as to allow the clamp arms to produce a clamping force, thereby clamping an object such as a workpiece or the like. When a user exerts a force to the first clamp arm 5 and the second clamp arm 52 to cause them to become far away from each other (that is, the first clamp arm 5 and the second clamp arm 52 move away from each other), the ratchet mechanism 0 is firstly required to be unlocked, which automatically opens under the effect of the elastic force of a spring 61, and the jaw opening becomes larger, thereby unclamping the workpiece.

Figure 3:
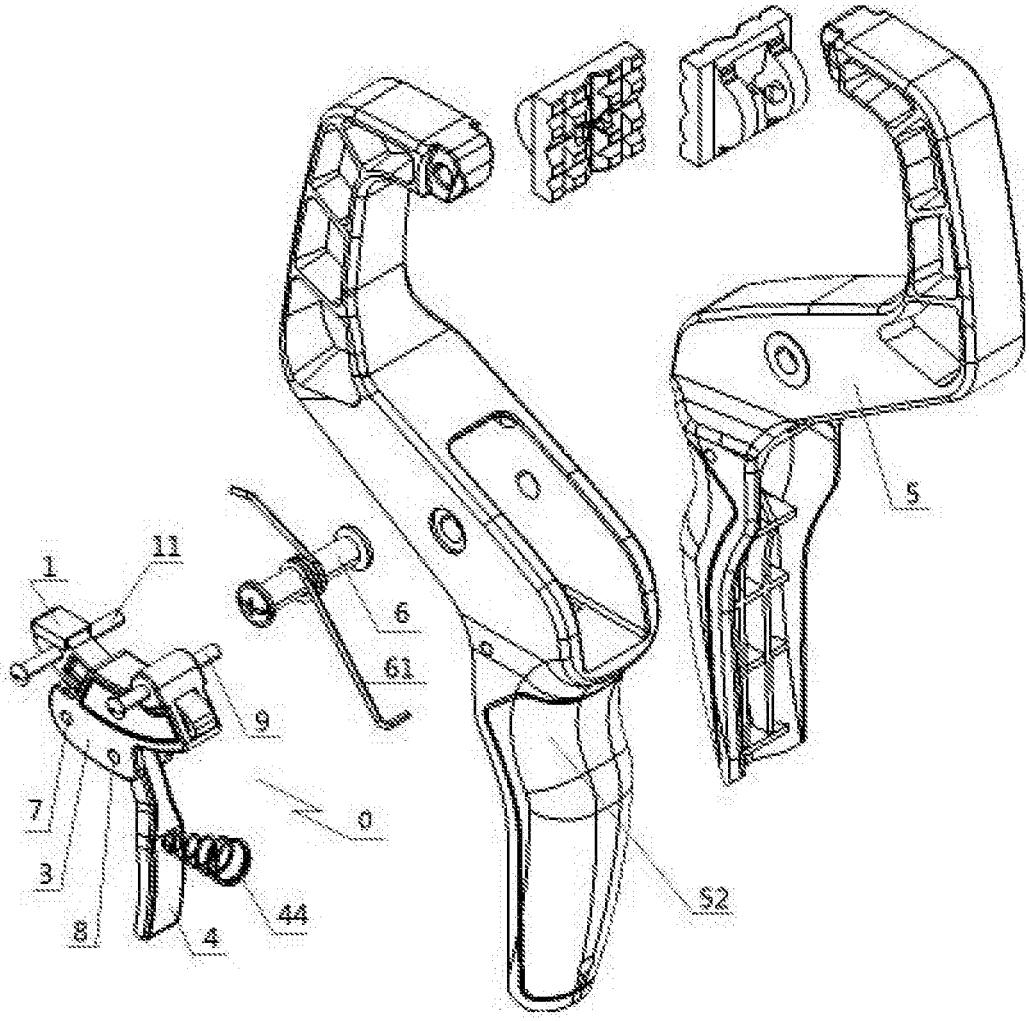
FIG. 3 is an exploded view of a whole ratchet clamp in a preferred embodiment of the present invention.
Figure 4:
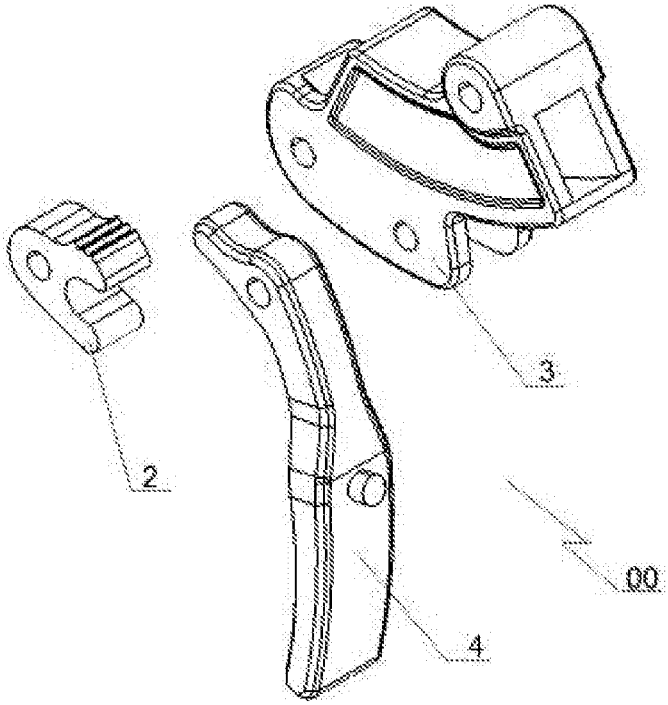
FIG. 4 is an exploded view of the pivoting member in a preferred embodiment of the present invention.

As shown in FIG. 3, an elastic member 44 is arranged between the ratchet mechanism 0 and the second clamp arm 52. The ratchet mechanism 0 is arranged between the first clamp arm 5 and the second clamp arm 52, and the ratchet mechanism 0 includes a toothed bar 1 and a pivoting member 00 (as shown in FIG. 4). The pivoting member 00 is pivotable about the third shaft 9, so as to ensure the pivoting member 00 can auto-adapt to the toothed bar 1 after the clamp tip and the clamp arm deform when the clamp body is under stress, so as to realize reliable engagement of the toothed bar 1 and the teeth 2 of the pivoting member.

Figure 5:
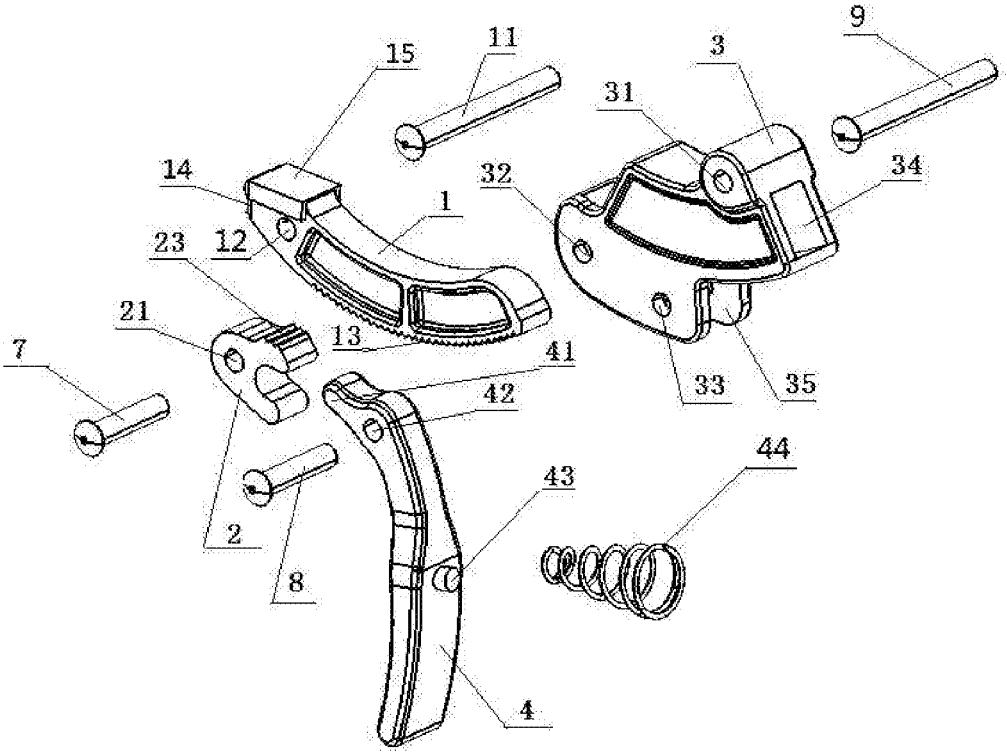
FIG. 5 is an exploded view of the ratchet mechanism in a preferred embodiment of the present invention.

As shown in FIG. 5, the toothed bar 1 is a circular arc in the shape of a strip, and the center point of the circular arc substantially coincides with that of the first shaft 6. A first set of ratchet teeth 13 is provided at the side of the toothed bar 1 away from the first shaft 6. One end of the toothed bar 1 is provided with a through-hole 12, for a pin 11 to pass through. The toothed bar 1 is fixedly connected to the first clamp arm 5 by the pin 11 and a first end face 14 and a second end face 15.

Figure 6:
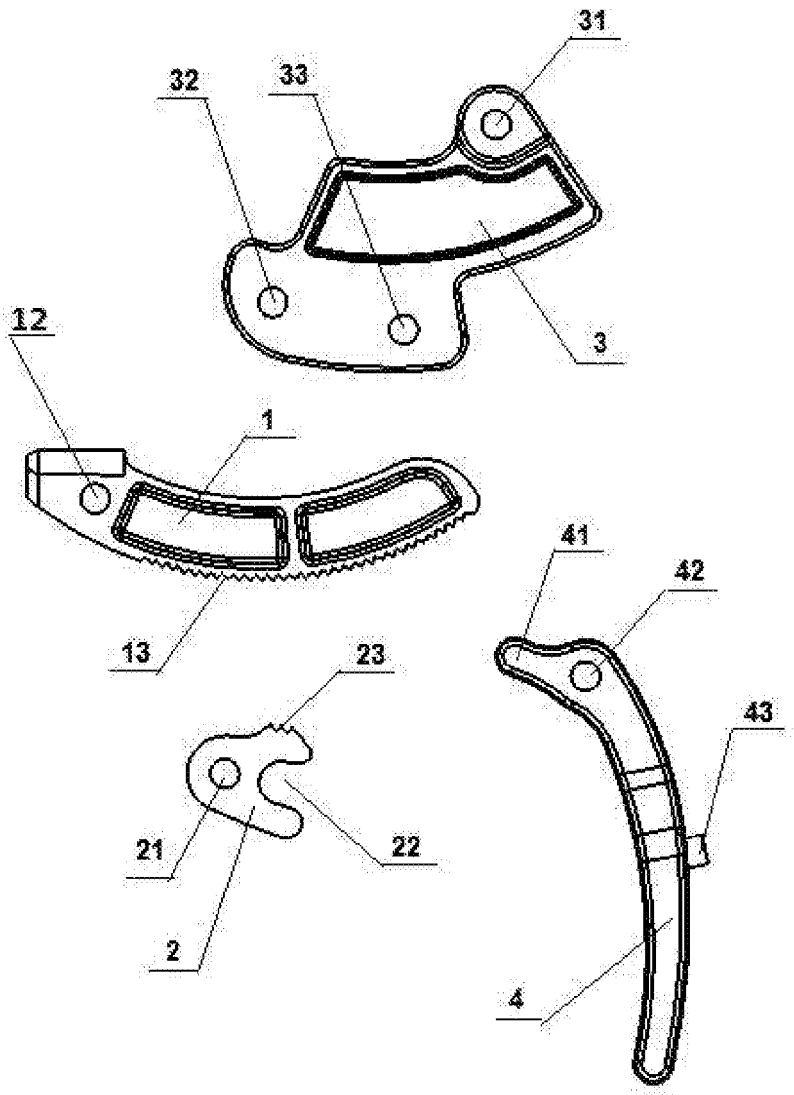
FIG. 6 is a perspective view of the toothed bar and the pivoting member in a preferred embodiment of the present invention.
Figure 7:
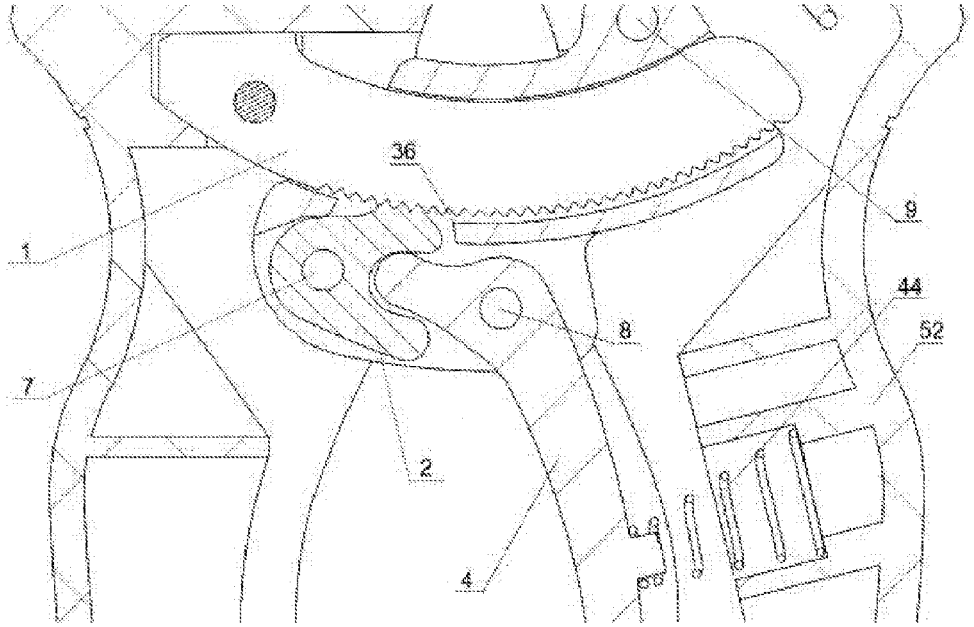
FIG. 7 is a sectional view of the ratchet clamp in a first state in a preferred embodiment of the present invention.

As shown in FIG. 4, the pivoting member 00 includes a toothed piece 2, a housing 3 and a lever 4. As shown in FIG. 5 and FIG. 6, the toothed piece 2 is provided with a through-hole 21, for a fourth shaft to pass through. The toothed piece 2 is rotatable about the fourth shaft 7. A recess portion 22 is also provided on the toothed piece 2. A second set of ratchet teeth 23 is provided on the side of the toothed piece 2 coming into contact with the toothed bar 1, and engage with the first set of ratchet teeth 13 of the toothed bar 1. The second set of ratchet teeth has at least more than one tooth, preferably three teeth. The lever 4 is in the form of an elongation, and a first protruding portion 41 and a through-hole 42 are provided at a first end portion. The first protruding portion 41 and the recess portion 22 of the toothed piece 2 cooperate with each other. The through-hole 42 is provided for a fifth shaft 8 to pass through, and the lever 4 is rotatable about the fifth shaft 8. A second protruding portion 43 is also provided on the lever 4, which cooperates with the elastic element 44. A channel 34 is provided in the housing 3, for the toothed bar 1 to pass through. A through-hole 31 is provided at the side of the channel 34 closer to the first shaft 6, for the third shaft 9 to pass through, and the housing 3 is rotatable about the third shaft 9. A through-hole 32 and a through-hole 33 are provided at the side of the channel 34 distal to the first shaft 6, both of which pass through the housing 3 at both sides of the housing 3. A slot 35 is provided between the both sides, which accommodates the toothed piece 2 and the first end portion of the lever 4. The fourth shaft 7 and the fifth shaft 8 respectively pass through the through-hole 32 and the through-hole 33, and the through-hole 21 in the toothed piece 2 and the through-hole 42 in the lever 4. As shown in FIG. 7, an opening 36 is provided at the side of the channel 34 distal to the first shaft 6, so as to facilitate engagement between the toothed piece 2 and the toothed bar 1.

As shown in FIG. 7, one end of the elastic member 44 is arranged on the second clamp arm 52, and the other end is arranged to cooperate with the second protruding portion 43 of the lever 4. When the end of the lever 4 distal to the through-hole 42 is free from external force, the lever 4 would produce a clockwise rotational motion about the fifth shaft 8 under the effect of the elastic force of the elastic member 44. The first protruding portion 41 of the lever 1 exerts a force to the toothed piece 2 in a direction toward where the first set of ratchet teeth 13 and the second set of ratchet teeth 23 are engaged with each other, which force causes the toothed piece 2 to rotate about the fourth shaft 7 and the engagement between the first set of ratchet teeth 13 and the second set of ratchet teeth 23 tighter.

Figure 10:
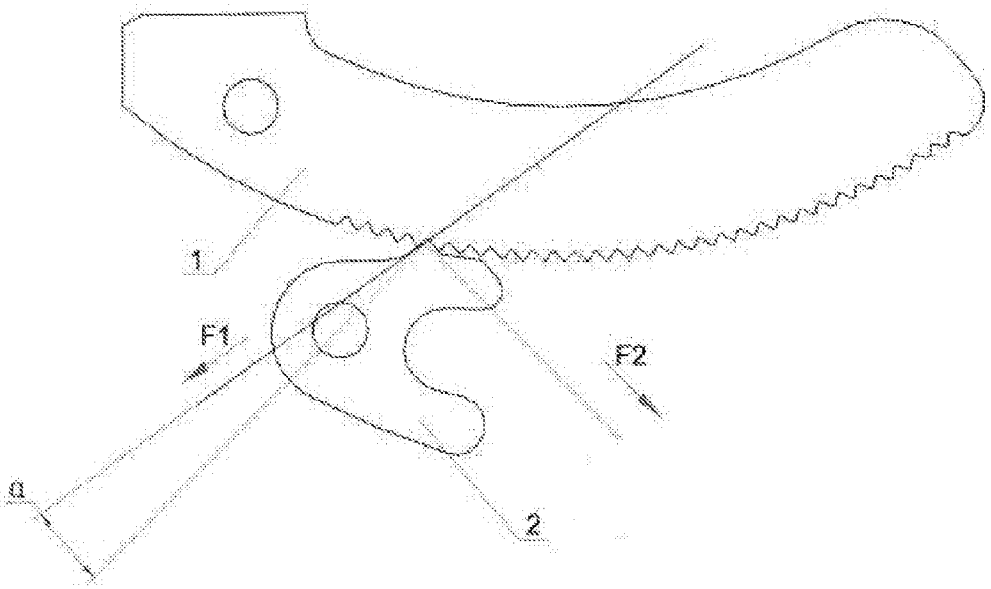
FIG. 10 is a force analysis perspective view of the toothed bar and the toothed piece in a preferred embodiment of the present invention.

As shown in FIG. 10, the toothed bar 1 and the toothed piece 2 tightly engage and lock with each other when a user removes the force exerted to the first clamp arm 5 and the second clamp arm 52 after the user exerts force to the first clamp arm 5 and the second clamp arm 52 to cause both clamp arms to come closer to each other and to clamp tightly the object to be clamped. The clamping force of the ratchet clamp of the invention is maintained, which is referred to as a first state. In order to enable stable and reliable engagement between the toothed bar 1 and the toothed piece 2, the tooth profile of the both in engagement is configured such that the force F1 produced thereby cause the toothed piece 2 to generate a counter-clockwise torque, that is, the forced direction of the tooth profile of the engaged part and the connection line between the forced point and the rotation center point of the toothed piece 2 form an angle $\alpha$. Because of the deformation of the ratchet clamp of the invention when under stress, deformation of the toothed bar 1 and the toothed piece also occurs to. In order to ensure reliable engagement between the toothed bar 1 and the toothed piece 2, and that, meanwhile, the engagement stress between the both can be overcome when the lever 4 is pulled, to detach the both, and the force for pulling the lever 4 should not be too great (generally between 5-10 kg), the angle $\alpha$ is in the range of between 2°-8°, preferably 4°. When the number of the teeth in engagement between the toothed bar 1 and the toothed piece 2 is more than 1, the both can reliably engage with each other as long as the resultant moment formed between all the teeth in engagement is ensured to cause a trend of a counter-clockwise motion of the toothed piece 2.

Figure 8:
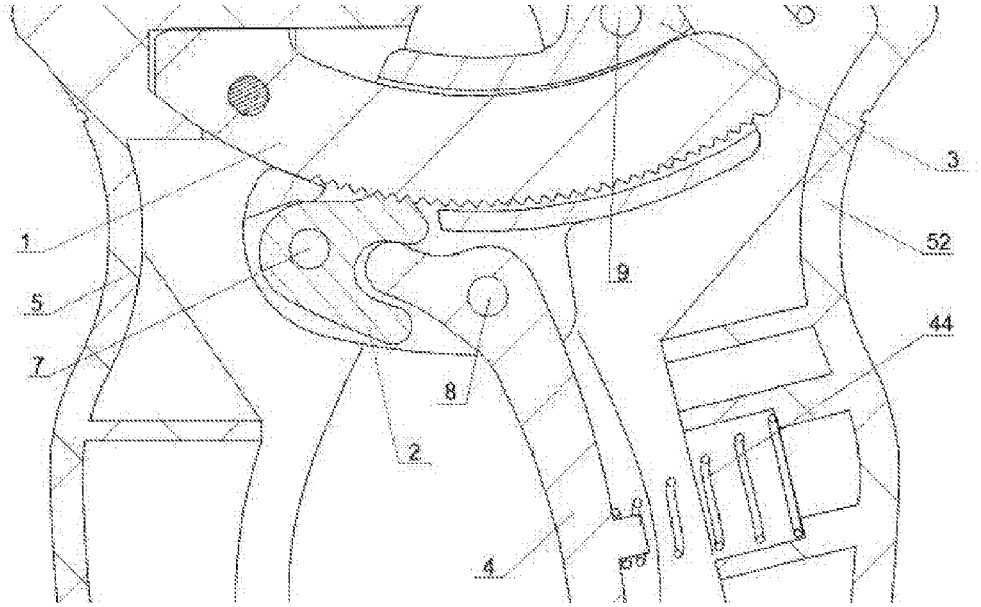
FIG. 8 is a sectional view of the ratchet clamp in a second state in a preferred embodiment of the present invention.

As shown in FIG. 8, when a user exerts forces to the first clamp arm 5 and the second clamp arm 52 to cause the first clamp arm 5 and the second clamp arm 52 to come closer to each other, the direction of the force generated between the toothed bar 1 and the toothed piece 2 is indicated by F2 in FIG. 10. The force F2 causes the toothed piece 2 to overcome the elastic force of the elastic member 44 and to rotate clockwise, so that the toothed bar 1 and the toothed piece 2 slide in relation to each other, causing the first clamp arm 5 and the second clamp arm 52 to come closer to each other, and the jaw opening of the ratchet clamp of the invention gradually reduces to clamp the workpiece, which is referred to as a second state.

Figure 9:
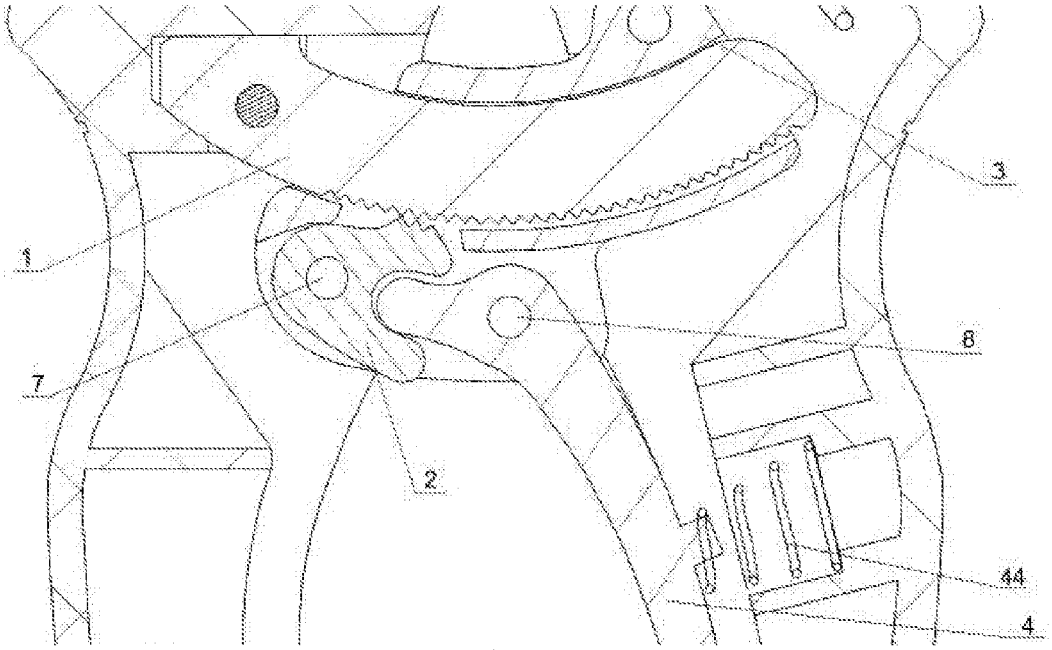
FIG. 9 is a sectional view of the ratchet clamp in a third state in a preferred embodiment of the present invention.

As shown in FIG. 9, when the ratchet clamp of the invention is under stress, a user exerts a force to the end of the lever distal to the through-hole 42, compressing the elastic member 44, and, meanwhile, the lever rotates counter-clockwise about the shaft 8, the first protruding portion 41 of the lever 4 pulling the toothed piece 2 to rotate clockwise about the fourth shaft 7. As aforementioned, the tooth profile between the toothed bar 1 and the toothed piece 2 is designed as a shape able to be unlocked, so as to facilitate the detachment of the engagement between the both. The ratchet clamp automatically opens under the effect of the spring 61 to facilitate unclamping the object which is clamped and proceeding with a new clamping operation, which is referred to as a third state.

Figure 11:
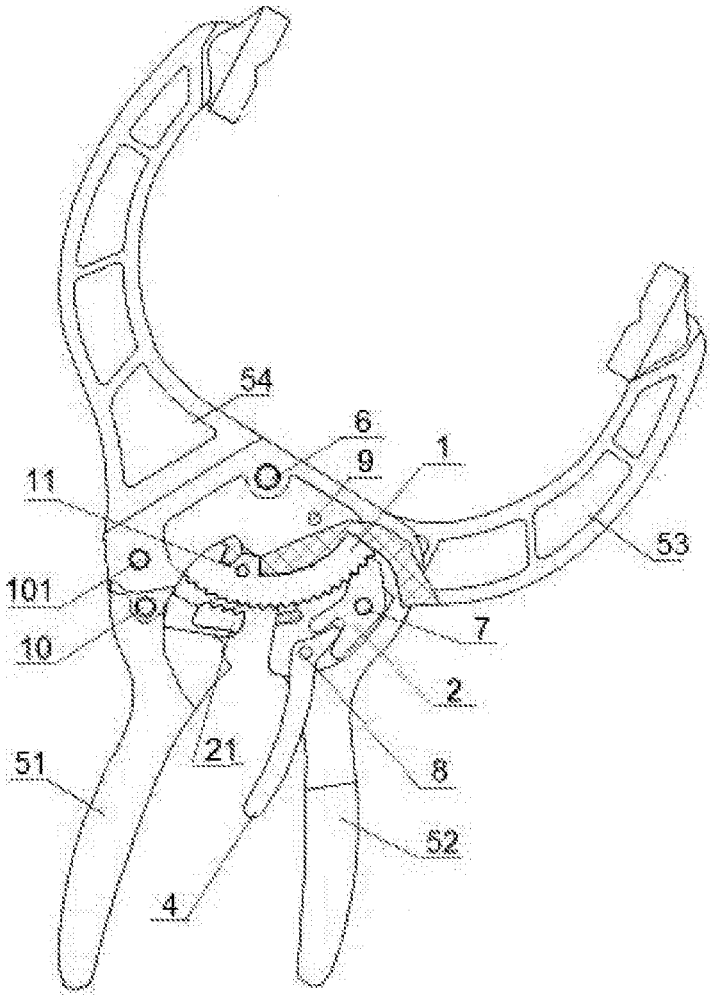
FIG. 11 is a perspective view of another preferred embodiment of the present invention.

The ratchet clamp shown in the invention is based on a rotation shaft to perform clamping and unclamping, similar to the form of a pair of scissors. However, the invention can also be used in a non-scissor application, in which the function is also achieved by designing the clamp body as a single section or multiple sections instead. The ratchet clamp as shown in FIG. 11 has its two clamp bodies both divided into two sections, where the second clamp arm and the second upper clamp body 53 are in a pivot connection by the third shaft 9, and the clamp arm 51 and the first upper clamp body 54 are in a pivot connection by a seventh shaft 101. Dial teeth 21 are in pivot connection to the clamp arm 51 by the sixth shaft 10. A third set of ratchet teeth is provided on the dial teeth 21. The dial teeth 21 and the clamp arm 51 are rotatable about the sixth shaft 10, and the teeth of the dial teeth 21 can engage with or detach from the toothed bar 1. The cooperation of the lever 4 with the toothed piece 2 and the toothed bar 1 is identical with the mechanism of maintaining the clamping force and unlocking in the above embodiment. The difference only lies in that multiple exertions of external forces to the clamp arm 51 can be utilized when the ratchet clamp is clamping. Such design has the advantage that the size of the jaw opening can be made much larger, and meanwhile, the two clamp arms are still kept in the range of operation with single hand grip.

The foregoing described the preferred embodiments of the present invention. It should be understood that an ordinary person skilled in the art can make many modifications and variations according to the concept of the present invention without creative work. Therefore, any person skilled in the art can get any technical solution through logical analyses, deductions and limited experiments, which should fall in the protection scope defined by the claims.

The invention claimed is:

1. A ratchet clamp, comprising a first clamp arm, a second clamp arm and a ratchet mechanism provided between the first clamp arm and the second clamp arm, the first clamp arm and the second clamp arm being connected by a first shaft and rotatable about the first shaft so as to control the size of the jaw opening, characterized in that, an elastic element is provided between the ratchet mechanism and the second clamp arm; the ratchet mechanism comprising a toothed bar and a pivoting member, the toothed bar being fixedly arranged on the first clamp arm, the toothed bar being a circular arc in shape of a strip, the center point of the circular arc being substantially coinciding with that of the first shaft, a first set of ratchet teeth being provided at a side of the toothed bar away from the first shaft, the pivoting member being pivotable about a third shaft within an elastic range of the elastic member during clamping; upon removal of external force, the ratchet mechanism self locks and maintains a clamping force; when the clamp is to be opened, an external force is exerted on the pivoting member so as to allow the ratchet mechanism to be unlocked and detached;

the pivoting member comprises a toothed piece, a housing and a lever, the toothed piece being rotatable about a fourth shaft, a recess portion being provided on the toothed piece, a second set of ratchet teeth being provided at a side of the recess portion and in engagement with the first set of ratchet teeth of the toothed bar;

a channel is provided in the housing, for the toothed bar to pass through, the housing being rotatable about the third shaft, a slot being provided at a side of the channel distal to a center point of the first shaft, the slot accommodating the toothed piece and the first end portion of the lever, the fourth shaft and the fifth shaft respectively passing through the slot and the toothed piece and the lever, an opening being provided on the separation of the channel and the slot.

2. The ratchet clamp as claimed in claim 1, characterized in that, the lever is in form of an elongation, the lever being rotatable about a fifth shaft, a first protruding portion being provided at a first end portion of the lever, the first protruding portion and the recess portion of the toothed piece cooperating with each other, a second protruding portion being provided in the middle portion of the lever, the second protruding portion cooperating with the elastic member.

3. The ratchet clamp as claimed in claim 2, characterized in that, a first end of the elastic member is arranged on the second clamp arm, a second end of the elastic member being arranged to cooperate with the second protruding portion of the lever, and when the lever is free from external force, the lever rotates about the fifth shaft due to the elastic force of the elastic member, the first protruding portion of the lever exerting a force to the toothed piece in a direction toward where the first set of ratchet teeth and the second set of ratchet teeth are engaged with each other, so that the toothed piece rotates about the fourth shaft and meanwhile, the engagement between the first set of ratchet teeth and the second set of ratchet teeth becomes tighter.

4. The ratchet clamp as claimed in claim 2, characterized in that, when a user exerts a force to an end of the lever so that the elastic member is compressed under stress, the lever is rotatable about the fifth shaft, the first protruding portion of the lever pulling the toothed piece to rotate about the fourth shaft, so that the first ratchet teeth of the toothed bar and the second ratchet teeth of the toothed piece are opened accordingly, so that the toothed bar is rotatable in the channel of the housing.

5. The ratchet clamp as claimed in claim 1, characterized in that, the first set of ratchet teeth of the toothed bar is provided with an undercut, and when a user removes forces exerted to the first clamp arm and the second clamp arm, the toothed piece is subjected to a circumferential acting force in an opposite direction of rotation about the fourth shaft, so that the toothed bar and the toothed piece are engaged and locked with each other.

6. The ratchet clamp as claimed in claim 1, characterized in that, when a user exerts forces to the first clamp arm and the second clamp arm to cause the first clamp arm and the second clamp arm to come closer to each other, the toothed bar and the housing are in relative movement, so that the pivoting member rotates about the third shaft in whole, so that the elastic member is compressed under stress and meanwhile, the first set of ratchet teeth of the toothed bar and the second ratchet teeth of the toothed piece are accordingly caused to be in a cycle process of engagement—open re-engagement.

7. The ratchet clamp as claimed in claim 1, characterized in that, the toothed bar and the toothed piece are in an interference fit.

8. The ratchet clamp as claimed in claim 1, characterized in that, angle $\alpha$ is an angle formed between, a forced direction of a tooth profile of an engaged part of the first ratchet teeth and the second ratchet teeth, and a connection line between a forced point and a rotation center point of the toothed piece, the angle $\alpha$ being in a range of between 2°-8°.

9. The ratchet clamp as claimed in claim 8, characterized in that, the angle $\alpha$ is preferably 4°.

10. The ratchet clamp as claimed in claim 1, characterized in that, the second set of ratchet teeth has at least more than one tooth.

11. The ratchet clamp as claimed in claim 1, characterized in that, preferably three teeth.

12. The ratchet clamp as claimed in claim 1, characterized in that, the elastic member is a spring.

13. A ratchet clamp, comprising a pair of clamp bodies, a ratchet mechanism provided between the clamp bodies, the clamp bodies comprising a clamp arm and an upper clamp body, a first upper clamp body and a second upper clamp body being pivotally connected by a first shaft, characterized in that, the clamp bodies are divided into two sections or more sections in pivot connections; the first upper clamp body being fixed relative to the first shaft, the second upper clamp body being rotatable relative to the first shaft the first upper clamp body and a first clamp arm being in pivot connection by a seventh shaft, the second upper clamp body and a second clamp arm being in pivot connection by a third shaft the ratchet mechanism comprises a toothed bar and a pivoting member, the toothed bar being fixedly arranged on the first upper clamp body, the toothed bar being a circular arc in shape of a strip, a center point of the circular arc substantially coinciding with that of the first shaft, a first set of ratchet teeth being provided at a side of the toothed bar distal to the first shaft and a third set of ratchet teeth being provided on dial teeth in pivot connection with the first clamp arm, the third set of ratchet teeth being in engagement with the toothed bar, the toothed bar being pushed by the toothed piece during clamping;

the pivoting member comprises a toothed piece, a housing and a lever, the toothed piece being rotatable about a fourth shaft, a recess portion being provided on the toothed piece, a second set of ratchet teeth being provided at a side of the recess portion and in engagement with the first set of ratchet teeth of the toothed bar;

a channel is provided in the housing, for the toothed bar to pass through, the housing being rotatable about the third shaft, a slot being provided at a side of the channel distal to a center point of the first shaft, the slot accommodating the toothed piece and the first end portion of the lever, the fourth shaft and the fifth shaft respectively passing through the slot and the toothed piece and the lever, an opening being provided on the separation of the channel and the slot.

14. The ratchet clamp as claimed in claim 13, characterized in that, the lever is in form of an elongation, the lever being rotatable about a fifth shaft, a first protruding portion being provided at a first end portion of the lever, the first protruding portion and the recess portion of the toothed piece cooperating with each other.

15. The ratchet clamp as claimed in claim 13, characterized in that, the first set of ratchet teeth of the toothed bar is provided with an undercut, and when a user removes forces exerted to the first clamp arm and the second clamp arm, the toothed piece is subjected to a circumferential acting force in an opposite direction of rotation about the fourth shaft, so that the toothed bar and the toothed piece are engaged and locked with each other.

16. The ratchet clamp as claimed in claim 13, characterized in that, when a user exerts forces to the first clamp arm and the second clamp arm to cause the first clamp arm and the second clamp arm to come closer to each other, the toothed bar and the housing are in relative movement, so that the pivoting member rotates about the third shaft in whole, so that the elastic member is compressed under stress and meanwhile, the first set of ratchet teeth of the toothed bar and the second ratchet teeth of the toothed piece are accordingly caused to be in a cycle process of engagement—open—re-engagement.

17. The ratchet clamp as claimed in claim 13, characterized in that, when a user exerts a force to an end of the lever so that the elastic member is compressed under stress, the lever is rotatable about the fifth shaft, the first protruding portion of the lever pulling the toothed piece to rotate about the fourth shaft, so that the first ratchet teeth of the toothed bar and the second ratchet teeth of the toothed piece are opened accordingly, so that the toothed bar is rotatable in the channel of the housing.

18. The ratchet clamp as claimed in claim 13, characterized in that, the toothed bar and the toothed piece are in an interference fit.

19. The ratchet clamp as claimed in claim 13, characterized in that, angle $\alpha$ is an angle formed between, a forced direction of a tooth profile of an engaged part of the first ratchet teeth and the second ratchet teeth, and a connection line between a forced point and a rotation center point of the toothed piece, the angle $\alpha$ being in a range of between 2°-8°.

20. The ratchet clamp as claimed in claim 19, characterized in that, the angle $\alpha$ is preferably 4°.

21. The ratchet clamp as claimed in claim 13, characterized in that, the second set of ratchet teeth has at least more than one tooth.

22. The ratchet clamp as claimed in claim 21, characterized in that, preferably three teeth.

* * * * *